US005941434A

United States Patent [19]

Green

[11] Patent Number: 5,941,434

[45] Date of Patent: Aug. 24, 1999

[54] MULTI-STRAP HOLDER

[76] Inventor: Mark R. Green, 3503 Greenwick Dr., North Las Vegas, Nev. 89030

[21] Appl. No.: 08/946,809

[22] Filed: Oct. 8, 1997

Related U.S. Application Data

[60] Provisional application No. 60/028,534, Oct. 11, 1996.

[51] Int. Cl.[6] ..... A45F 3/14

[52] U.S. Cl. ..... 224/250; 224/195; 224/269

[58] Field of Search ..... 224/195, 222, 224/269, 271, 250, 901, 904, 907, 929, 930, 425, 427, 275, 276; 248/206.3, 205.2, 205.6, 311.2; 294/150, 151, 149, 157

[56] References Cited

U.S. PATENT DOCUMENTS

| | | | |
|---|---|---|---|
| D. 203,101 | 12/1965 | Holder | D3/10 |
| D. 316,999 | 5/1991 | Sarff | D14/253 |
| 417,220 | 12/1889 | Bell . | |
| 591,904 | 10/1897 | Weber | 224/425 |
| 1,320,934 | 11/1919 | Schopp | 224/250 |
| 3,144,230 | 8/1964 | Brooks | 224/148 |
| 4,771,927 | 9/1988 | Ventura | 224/252 |
| 5,147,079 | 9/1992 | Heather | 224/148 |
| 5,174,483 | 12/1992 | Moore, IV et al. | 224/250 |
| 5,325,991 | 7/1994 | Williams | 220/739 |
| 5,407,110 | 4/1995 | Marsh, Jr. | 224/148 |
| 5,535,928 | 7/1996 | Herring | 224/250 |
| 5,678,793 | 10/1997 | Hill | 248/206.3 |

OTHER PUBLICATIONS

VELCRO Product News, Velco International Ltd., p. 11, Feb. 1975.

*Primary Examiner*—Henry J. Recla
*Assistant Examiner*—Timothy L. Maust
*Attorney, Agent, or Firm*—Kenehan Lambertsen & Stein; John C. Lambersen

[57] ABSTRACT

A holder/carrier temporarily attaches to and supports small items of multiple configurations. Using multiple, flexible straps that are each attached to a support base, the item is enwrapped and retained against the support base. An attachment mechanism, such as a retaining clip, is affixed to the support base, and is utilized to selectively attach the support base, along with the carried, enwrapped item, to a separate supporting structure, such as a waistband, belt or other, suitably-shaped, receiving structures. Additionally, by securing an attachment device that is cooperative with the support base attachment mechanism to another support surface, whether on a permanent or temporary basis, the attachment mechanism may be attached to support surfaces that would not otherwise be suitable.

4 Claims, 2 Drawing Sheets

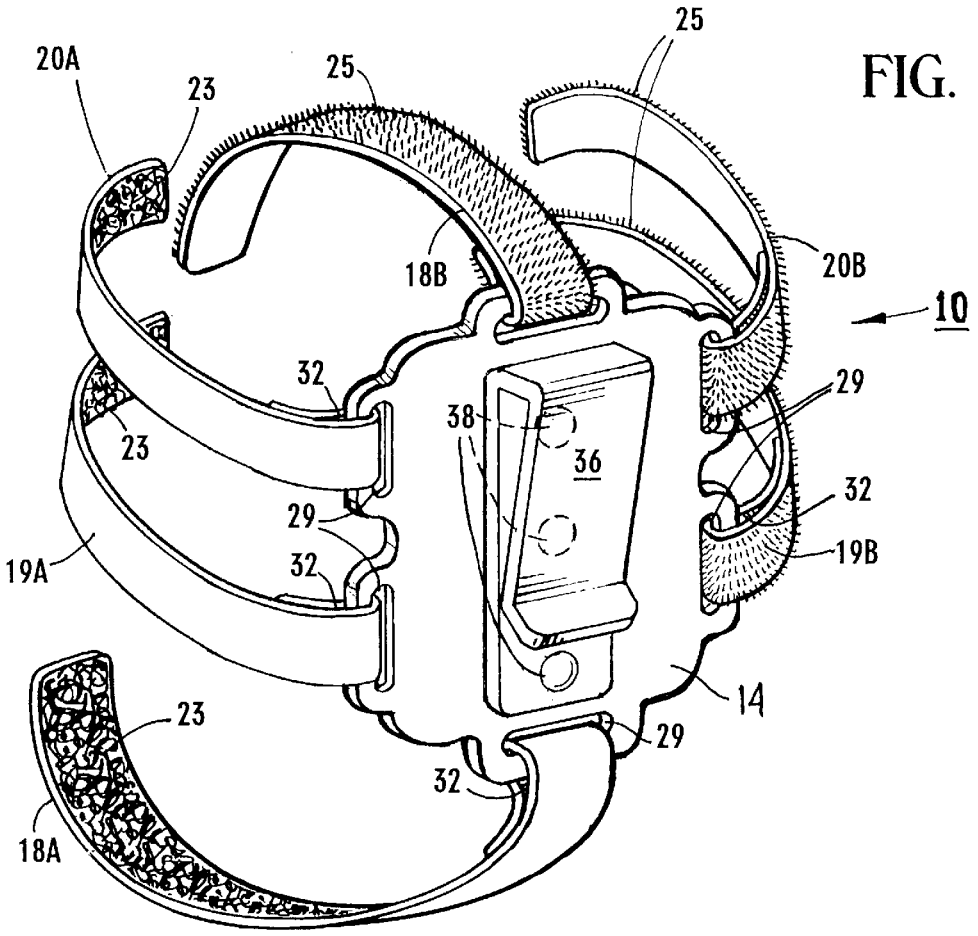
FIG. 1
FIG. 2
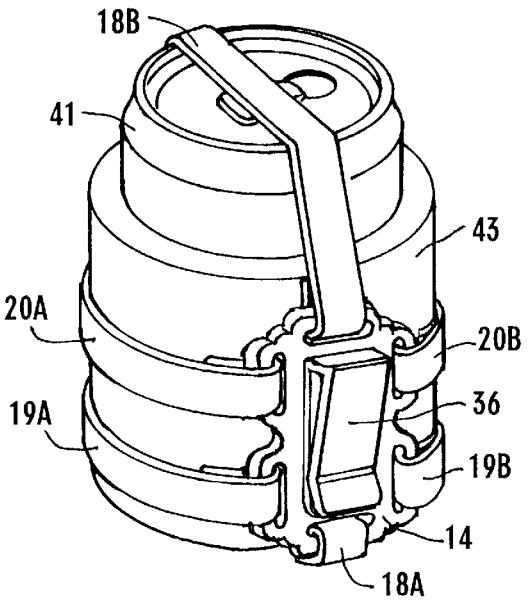
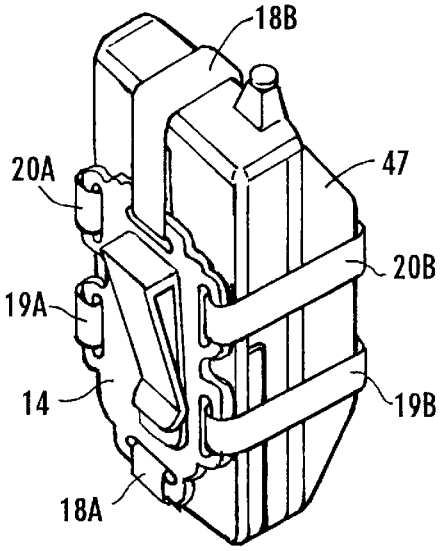
FIG. 3

MULTI-STRAP HOLDER

Cross-Reference to Related Application

This application claims the benefit of U.S. Provisional Application No. 60/028,534, filed Oct. 11, 1996.

BACKGROUND OF THE INVENTION

1. Field of the Invention

The present invention relates to holders/carriers and, more particularly, to such devices as can be selectively attached to various supporting structures. More specifically, the present invention relates to a holder that includes a rigid or semi-rigid base support, several non-elastic securement straps, and a support attachment mechanism.

2. Description of the Prior Art

A variety of devices are disclosed in the prior art for carrying various types of articles suspended from "the person", such as a belt or waistband, or attached to an object within the user's immediate environment, such as the passenger compartment in cars and trucks. While tool belts have been used for years, the recent cultural popularity of carrying water bottles during the completion of one's daily tasks, and the development of cellular telephones has changed the traditional areas of product focus for these hands-free carriers.

With cellular telephone technology becoming a ubiquitous intrusion on both business and personal life, increasing numbers of users feel compelled to carry a cellular phone throughout their day. With many day-to-day tasks requiring the use of both hands, this requirement for immediate (and continual) access to a cellular phone can produce awkward balancing acts and other inconveniences.

It then becomes only a matter of time before the phone is accidentally dropped, damaging its sensitive electronics and fragile plastic parts. As a result, many times cellular telephone users will purchase a leather or vinyl carrying case, most of which include a rigid clip that can be used to attach the case and phone to a waistband or belt.

In addition to cellular phones, during the warmer months in many areas of the country it is common for people to carry along chilled beverages while traveling about during the day. To facilitate their transport, a number of different types of container designs have been made available to hold the beverage cans or drinking cups. Some of these holders are designed primarily to provide thermal insulation. Others include structures that permit the cup or beverage can to be suspended from a variety of different support platforms. For example, some beverage holders permit the beverage container to be suspended from a person's belt while others have specialized support structures that permit their engagement with, and suspension from, various structural features commonly found in the passenger compartments of most automobiles. Previous such containers include the plastic bottle carriers of Heather, U.S. Pat. No. 5,147,079, and Marsh, Jr., U.S. Pat. No. 5,407,110.

While such beverage and cellular phone holders are more or less adequate for the particular purpose for which they have been designed, there are certain deficiencies inherent in such custom holders. Such holders are generally designed to receive an object having a specific dimensional configuration. Many such holders can only be utilized for retaining an object of certain, specific dimensions—and for no other objects. Seldom are holders suitable for more than one cellular phone model.

In an attempt to address this deficiency, the use of flexible straps with hook/loop fasteners is suggested by both Ventura, U.S. Pat. No. 4,771,927, and Moore, IV, et al., U.S. Pat. No. 5,174,483, for use with telephones and radios. In the context of beverage containers, they too come in a variety of different shapes, and an entirely separate family of holders is required for each of the various different beverage containers. In a manner similar to the previously-described multi-cellular holders, Williams, U.S. Pat. No. 5,325,991, suggests a strategy of providing a flexible insulated blanket to be used to wrap around and hold beverages containers. A separate rigid vertical support is provided to attach and suspend the beverage holder from a separate supporting structure.

Ideally, it would be desirable to provide a holder that is sufficiently adaptable as to be able to carry any number of different, multi-shaped objects, rather than require specialized carrying devices specific to either drinking containers, cellular phones or tools, for example.

SUMMARY OF THE INVENTION

It is an object of the present invention to provide a holder or carrier for small objects of a variety of different shapes, such as binoculars, cameras, cellular phones, water bottles, flashlights, calculators, hand tools, wallets, and the like. A rigid or semi-rigid support base is provided, with multiple flexible straps attached. Each of the straps is provided with hook and loop fastener material, such that any one of the straps can attach to or be attached by another of the straps. In this manner, the straps can be "wrapped" about an object of virtually any shape, forming a supportive carrier about that object.

A support attachment mechanism, such as a clip or an array of suction disks, by way of example and not limitation, is attached to the rigid or semi-rigid base, and enables the selectable attachment of the holder/carrier to a variety of support structures. The more common include waistbands and belts; however, when mating clips are attached to the support structures as well, the holder/carrier is able to form a secure connection to a variety of supporting structures that would not otherwise be suitable for attachment of the holder.

Some further objects and advantages of the present invention shall become apparent from the ensuing description and as illustrated in the accompanying drawings.

BRIEF DESCRIPTION OF THE DRAWINGS

FIG. 1 is a perspective view, with portions in phantom, showing a multi-strap holder in accordance with the present invention;

FIG. 2 is a perspective view, similar to FIG. 1, showing a multi-strap holder in releasable engagement with an insulated beverage container;

FIG. 3 is a perspective view, similar to FIGS. 1 and 2, showing a multi-strap holder releasably engaged with a cellular telephone in accordance with the present invention.

DETAILED DESCRIPTION OF THE PREFERRED EMBODIMENTS

Figure 4:
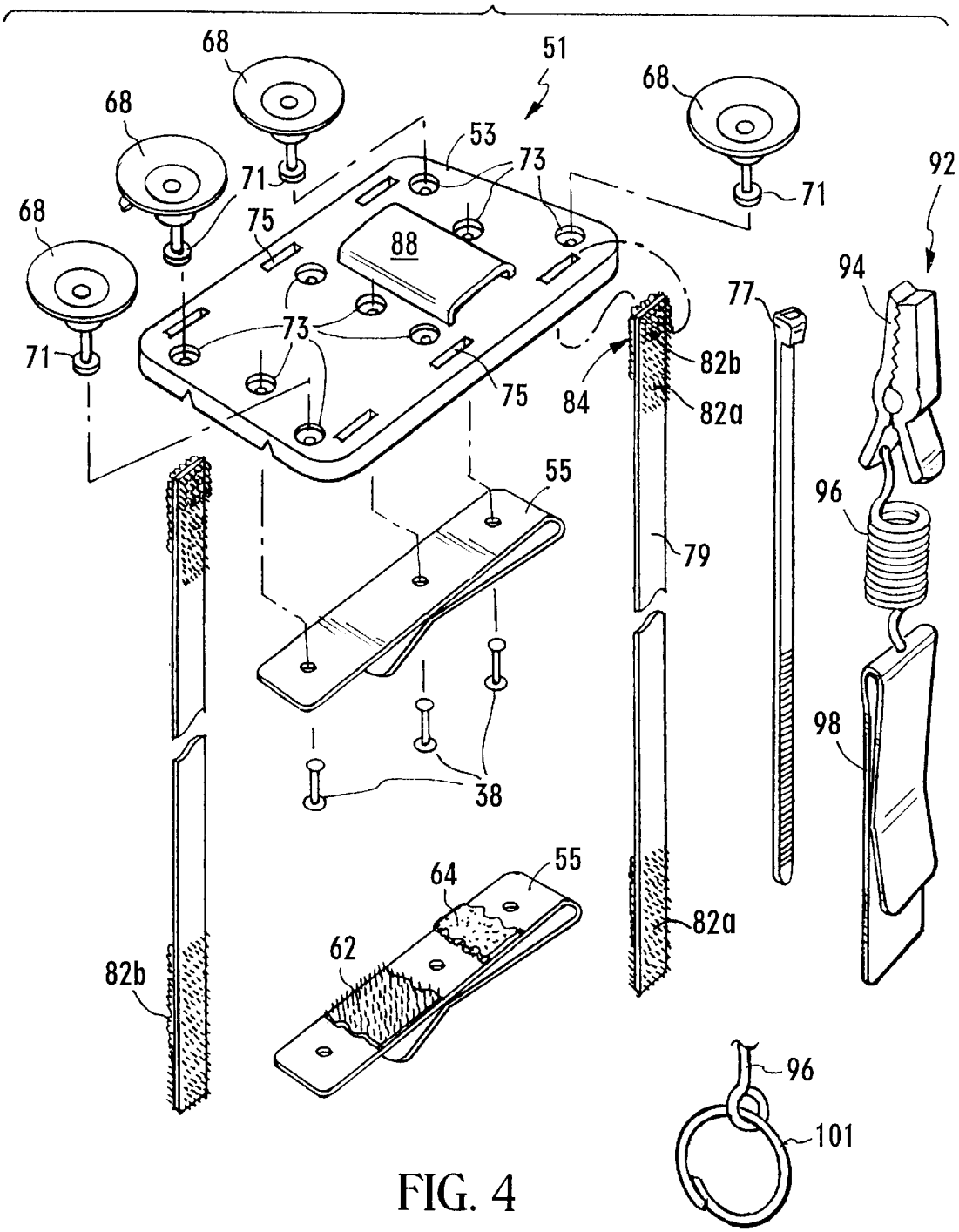
FIG. 4 is a partial perspective view showing a backplate and various possible mounting hardware permitting the attachment of a multi-strap holder to an increased number of possible support surfaces in accordance with the present invention.

Reference is now made to the drawings wherein like numerals refer to like parts throughout. Referring to FIG. 1, a multi-strap holder 10 includes a central support backing 14, from which extends a plurality of support straps, preferably in the form of a plurality of support strap pairs 18A, 18B, 19A, 19B, 20A, 20B.

Each of the support strap pairs 18A–20B includes a fastening mechanism that enables the releasable attachment to one another of the respective support straps of each support strap pair. In a preferred embodiment hook and loop fasteners are provided. One strap of each of the support strap pairs 18A, 19A, 20A is provided with a loop section 23 and the corresponding support straps 18B, 19B, 20B of the support strap pairs are each provided with a hook section 25.

The selection as to which portion, hook or loop, is on which support strap is not critical. It is to be understood and appreciated that the arrangement of the hook and loop areas shown in FIG. 1 is provided by way of example and not of limitation.

The support strap pairs 18A–20B, which are preferably constructed out of hook and loop fabric straps, may be attached to the central support backing 14 in a variety of ways known to the art. For example, when the central support backing 14 is a plastic material formed by injection molding, the support strap pairs 18A–20B are placed in the mold prior to the injection formation of the central support backing 14.

In the preferred embodiment shown in FIG. 1, a plurality of strap retaining apertures 29 are formed about a periphery of the central support backing 14. A fastening loop section 32 is formed on each of the support straps, and is appropriately dimensioned to permit reception of each support strap on a respective retaining aperture 29.

The central support backing 14 is also preferably provided with a fastening clip 36 that is attached to the support backing 14 using a plurality of rivets 38. It would also be possible to attach the fastening clip 36 by molding it into the support backing 14 during the formation thereof. In a conventional manner, the fastening clip 36 is provided to permit the releasable attachment of the multi-strap holder 10 to any of a variety of supporting structures and/or support mounts (not shown in the Figures).

Turning now to FIG. 2, a beverage container 41 is shown securely received within a gripping web formed by the attached support strap pairs 18A–20B. The beverage container 41 in FIG. 2 is shown received within an insulating cup 43; however, removal of the insulating cup 43 would not impair the ability of the support strap pairs 18A–20B to form a gripping web of reduced size to retain the beverage container 41.

The length of the loop sections 23 and hook sections 25 formed on the support strap pairs 18A–20B is preferably the entire length of the strap, which provides a great deal of adaptability to the holder regarding the shapes of the articles to be held. A great degree of adjustability of the support strap pairs is thereby obtained, which in turn permits a wide variance in the dimensions of the object received within the gripping web.

The adaptability of the support strap pairs 18A–20B to form gripping webs of various dimensions is further illustrated by reference to FIG. 3. A cellular phone 47 is shown received within the gripping web formed by the support strap pairs 18A–20B. While most cellular phones are substantially rectangular in overall shape, they each have their design peculiarities. In the cellular phone 47 shown in FIG. 3, there are variations in thickness over the overall length of the phone, making the gripping web particularly useful in retaining the phone against the central support backing 14.

The central support backing 14 can be fabricated out of a number of materials, including metal, leather, wood and plastic, with a semi-flexible PVC plastic as the preferred material. Similarly a number of materials can be used to fabricate the support straps, including leather, nylon and polypropylene. A preferred material for the support straps is the widely available hook and loop fabric strips.

Additionally, as mentioned previously, a number of different fastening systems may be used with the support straps; however, the hook and loop fastening system as previously described is preferred. Finally, while a number of materials are appropriate for fabricating the fastening clip 36, a spring steel clip cast into a plastic backing is preferred as minimizing the cost of fabrication while optimizing durability of the clip.

It is oftentimes desirable to be able to attach the multi-strap holder 10 to support surfaces that do not provide a secure attachment location for the fastening clip 36. In such instances a support base 51, such as is shown in FIG. 4, can prove exceedingly useful. A backplate 53 provides a platform upon which various mounting hardware can be attached.

The interconnection with the multi-strap holder 10, is preferably formed using a retaining clip 55. When so provided, the fastening clip 36, readily engages therewith to form a strong and secure detachable connection between the multi-strap holder 10 (not shown in FIG. 4) and the support base 51. A preferred fastener for attachment of the retaining clip 55 to the backplate 53 are the plurality of rivets 38 illustrated in FIG. 4.

Where a less expensive alternative is desired, the retaining clip 55 can be used alone, without the support base 51, and be attached to support surfaces using other fasteners. A less complex fastening system might preferably consist of a strip of cooperating hook and loop fastening material 62 attached to the retaining clip 55 as well as on/to a desired support surface location such as a wall (not shown). Alternatively, a double-sided adhesive layer 64 might also be used in a similar manner to attach the retaining clip 55 to a suitable support surface.

Returning again to the support base 51, its attachment to any of a variety of support surfaces (not shown) can utilize a number of attachment devices, with the nature of the particular support surface determining that attachment device likely to be the most effective. For example, on smooth surfaces, a plurality of suction cups 68 is likely to be effective. An attachment head 71 of the suction cup 68 is used to firmly secure the suction cup 68 to the backplate 53. A plurality of securement apertures 73 are preferably formed in the backplate 53 and of a dimension suitable for receiving the attachment head 71 and securing same therein, whether by a rivet or a screw (not shown). The securement apertures 73 are also suitable for receiving the rivets 38 when they are used to secure the retaining clip 55 to the backplate 53.

For support surfaces not amenable to forming a secure attachment using the plurality of suction cups 68, a plurality of securement slots 75 are formed about the periphery of the backplate 53 and are suitable for receiving securement devices such as a plastic tie 77. When a less permanent connection is desired, securement straps 79 making use of cooperating hook and loop fastening material 82*a*, 82*b* can also utilize the securement slots 75 to anchor the support base 51 to a suitable support surface for the multi-strap holder 10.

The attachment of the securement straps 79 to the backplate 53 is preferably accomplished by utilizing the hook and loop fastening material 82*a*, 82*b* placed adjacent one-another at an attachment end 84 of the securement strap 79.

As so located, a secured loop can be formed by the doubling-back of the securement strap 79 once the attachment end 84 is received within the securement slot 75. The juxtaposed hook and loop fastening material 82*a*, 82*b* can then be pressed together, releasably securing one to the other, and thereby attaching the securement strap 79 to the backplate 53.

Although the fastening clip 36 of the multi-strap holder 10 may be used to releasably secure the multi-strap holder 10 to a belt or waistband (not shown), when a more secure connection is desired, the backplate 53 can be provided with a belt loop 88 attached thereto. With the support base 51 securely received upon a belt being worn by a person (not shown), the fastening clip 36 can then be used to attach the multi-strap holder 10 to the retaining clip 55.

A still further level of security can be obtained by the use of a lanyard 92. An alligator clip 94 is provided, and can be used to attach the lanyard 92 to any of a variety of sites on clothing or other personal accessories (not shown). A flexible cord 96 connects the alligator clip 94 to a clip 98 having a design suitable for attachment to the fastening clip 36 of the multi-strap holder 10. Alternatively, the flexible cord 96 of the lanyard 92 can be attached to a slip ring 101 of the type frequently used as a key ring. The slip ring 101, in turn, can be selectively received and releasably retained by the fastening clip 36.

My invention has been disclosed in terms of a preferred embodiment thereof, which provides an improved adjustable holder of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A carrier for hand-held items of varying shapes and sizes comprising:

a central support backing;

a plurality of support straps, each attached to said central support backing and extending therefrom;

a plurality of individual fastener components that together form at least one multi-component mechanical fastener, wherein each of said plurality of individual fastener components is attached to a separate one of said plurality of support straps in a manner such that individual support straps may be selectively fastened to one another;

a fastener attached to said central support backing;

mounting hardware selectively attached to a support surface, said mounting hardware configured in a manner to permit the detachable attachment of said fastener of the central support backing; and an attachment surface formed on said mounting hardware and selectively attachable to said support surface, wherein said fastener attached to said central support backing is a fastening clip, and wherein a second fastening clip is attached to said mounting hardware, said second fastening clip configured in a manner permitting the selective interengagement of said second fastening clip with the fastening clip attached to said central support backing, whereby such small, hand-held items may be enwrapped and secured against the central support backing by the interconnected plurality of support straps.

2. A carrier according to claim 1, and further comprising:

a plurality of suction cups attached to and projecting from said attachment surface.

3. A carrier according to claim 1, and further comprising:

cooperating hook and loop fastening material attached to said attachment surface and to said support surface.

4. A carrier according to claim 1, and further comprising:

a double-sided adhesive attached to said attachment surface.

* * * * *